US011053621B2

(12) United States Patent
Dedow et al.

(10) Patent No.: US 11,053,621 B2
(45) Date of Patent: Jul. 6, 2021

(54) WASHING MACHINE APPLIANCES AND METHODS OF OPERATION FOR DETERMINING LOAD SIZE

(71) Applicant: Haier US Appliance Solutions, Inc., Wilmington, DE (US)

(72) Inventors: Gregory Allen Dedow, Louisville, KY (US); Martin Ortega Brena, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 275 days.

(21) Appl. No.: 16/149,245

(22) Filed: Oct. 2, 2018

(65) Prior Publication Data

US 2020/0102687 A1 Apr. 2, 2020

(51) Int. Cl.

| | |
|---|---|
| ***D06F 33/00*** | (2020.01) |
| ***D06F 34/18*** | (2020.01) |
| ***D06F 37/12*** | (2006.01) |
| ***D06F 37/30*** | (2020.01) |
| *D06F 103/24* | (2020.01) |
| *D06F 105/00* | (2020.01) |

(52) U.S. Cl.

CPC ..... *D06F 34/18* (2020.02); *D06F 33/00* (2013.01); *D06F 37/12* (2013.01); *D06F 37/30* (2013.01); *D06F 2103/24* (2020.02); *D06F 2105/00* (2020.02)

(58) Field of Classification Search

CPC ..... D06F 33/00; D06F 34/18; D06F 37/12; D06F 37/30; D06F 2103/24; D06F 2105/00

USPC ..... 8/158, 159; 68/12.01, 12.02, 12.04, 68/12.06, 12.16

See application file for complete search history.

(56) References Cited

U.S. PATENT DOCUMENTS

| | | | |
|---|---|---|---|
| 6,374,444 | B2 | 4/2002 | Skrippek et al. |
| 7,530,133 | B2 | 5/2009 | Mitts |
| 8,122,549 | B2 | 2/2012 | Park et al. |
| 8,176,798 | B2 | 5/2012 | Ashrafzadeh et al. |
| 8,215,134 | B2 | 7/2012 | Ashrafzadeh et al. |
| 8,381,569 | B2 | 2/2013 | Lilie et al. |
| 2006/0242768 | A1 | 11/2006 | Zhang et al. |

(Continued)

FOREIGN PATENT DOCUMENTS

| | | | |
|---|---|---|---|
| EP | 1857583 | A1 | 11/2007 |
| EP | 2765230 | A1 | 8/2014 |

(Continued)

*Primary Examiner* — Levon J Shahinian

(74) *Attorney, Agent, or Firm* — Dority & Manning, P.A.

(57) ABSTRACT

A washing machine appliance and method of operation for determining load size are provided herein. The washing machine appliance may include a cabinet, a tub, a wash basket, a measurement device, a motor, and a controller. The cabinet may include a front panel. The front panel may define an opening. The tub may be positioned within the cabinet. The wash basket may be rotatably mounted within the tub. The wash basket may define a wash chamber to receive an article load of one or more articles. The measurement device may detect movement of the tub. The motor may be in mechanical communication with the wash basket to selectively rotate the wash basket within the tub. The controller may be in operative communication with the measurement device and the motor.

20 Claims, 10 Drawing Sheets

(56) References Cited

U.S. PATENT DOCUMENTS

| | | | | |
|---|---|---|---|---|
| 2011/0030460 | A1* | 2/2011 | Ashrafzadeh | D06F 33/00 73/65.01 |
| 2014/0215725 | A1 | 8/2014 | Paglia et al. | |
| 2016/0053422 | A1* | 2/2016 | Im | D06F 39/087 8/137 |

FOREIGN PATENT DOCUMENTS

| | | | |
|---|---|---|---|
| EP | 1995366 | B1 | 5/2015 |
| JP | 2010194078 | A | 9/2010 |
| JP | 2013027448 | A | 2/2013 |

* cited by examiner

WASHING MACHINE APPLIANCES AND METHODS OF OPERATION FOR DETERMINING LOAD SIZE

FIELD OF THE INVENTION

The present subject matter relates generally to washing machine appliances, such as horizontal axis washing machine appliances, and methods for monitoring load balances in such washing machine appliances.

BACKGROUND OF THE INVENTION

Washing machine appliances generally include a tub for containing water or wash fluid (e.g., water and detergent, bleach, or other wash additives). A basket is rotatably mounted within the tub and defines a wash chamber for receipt of articles for washing. During normal operation of such washing machine appliances, the wash fluid is directed into the tub and onto articles within the wash chamber of the wash basket. the wash basket or an agitation element can rotate at various speeds to agitate articles within the wash chamber, to wring wash fluid from articles within the wash chamber, etc. Washing machine appliances include vertical axis washing machine appliances (i.e., top-loading washing machine appliances) and horizontal axis washing machine appliances (i.e., front-loading washing machine appliances), where "vertical axis" and "horizontal axis" refer generally to the rotation axis of the wash basket within the tub.

A common concern during operation of washing machine appliances is an accurate evaluation of the load size for articles loaded within the wash basket of the washing machine appliance. In some washing machine appliances, the load size is utilized to influence a washing operation and can determine, for instance, basket speed, the volume of wash additive or wash fluid added to the wash basket, etc. If an improper or inaccurate load size is utilized, articles may become damaged or be insufficiently cleaned over the course of the washing operation.

Despite its importance, load size is commonly a user-specified input. However, it may be difficult for a user to accurately determine the proper input or size of a given load. Moreover, existing systems for automatically determining a load size (e.g., without a specific user-specified input or determination) may be prone to inaccuracies or require resource-intensive calculations.

Accordingly, improved methods and apparatuses for determining a load size in washing machine appliances are desired. In particular, methods and apparatuses that provide for an accurate determination and compensation for a specific load during a washing operation would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method may include directing a discrete rotational impulse to a wash basket through a motor in mechanical communication with the wash basket. The method may also include measuring displacement of the tub at a measurement device to detect movement of the tub. Measuring displacement may follow directing the discrete rotational impulse. The method may further include determining a load size of an article load within the wash basket based on the measured displacement.

In another exemplary aspect of the present disclosure, a washing machine appliance is provided. The washing machine appliance may include a cabinet, a tub, a wash basket, a measurement device, a motor, and a controller. The cabinet may include a front panel. The front panel may define an opening. The tub may be positioned within the cabinet. The wash basket may be rotatably mounted within the tub. The wash basket may define a wash chamber to receive an article load of one or more articles. The measurement device may detect movement of the tub. The motor may be in mechanical communication with the wash basket to selectively rotate the wash basket within the tub. The controller may be in operative communication with the measurement device and the motor. The controller may be configured to initiate a washing operation. The washing operation may include directing a discrete rotational impulse to the wash basket through the motor, measuring displacement of the tub at the measurement device, and determining a load size of the article load based on the measured displacement. Measuring displacement may follow directing the discrete rotational impulse.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
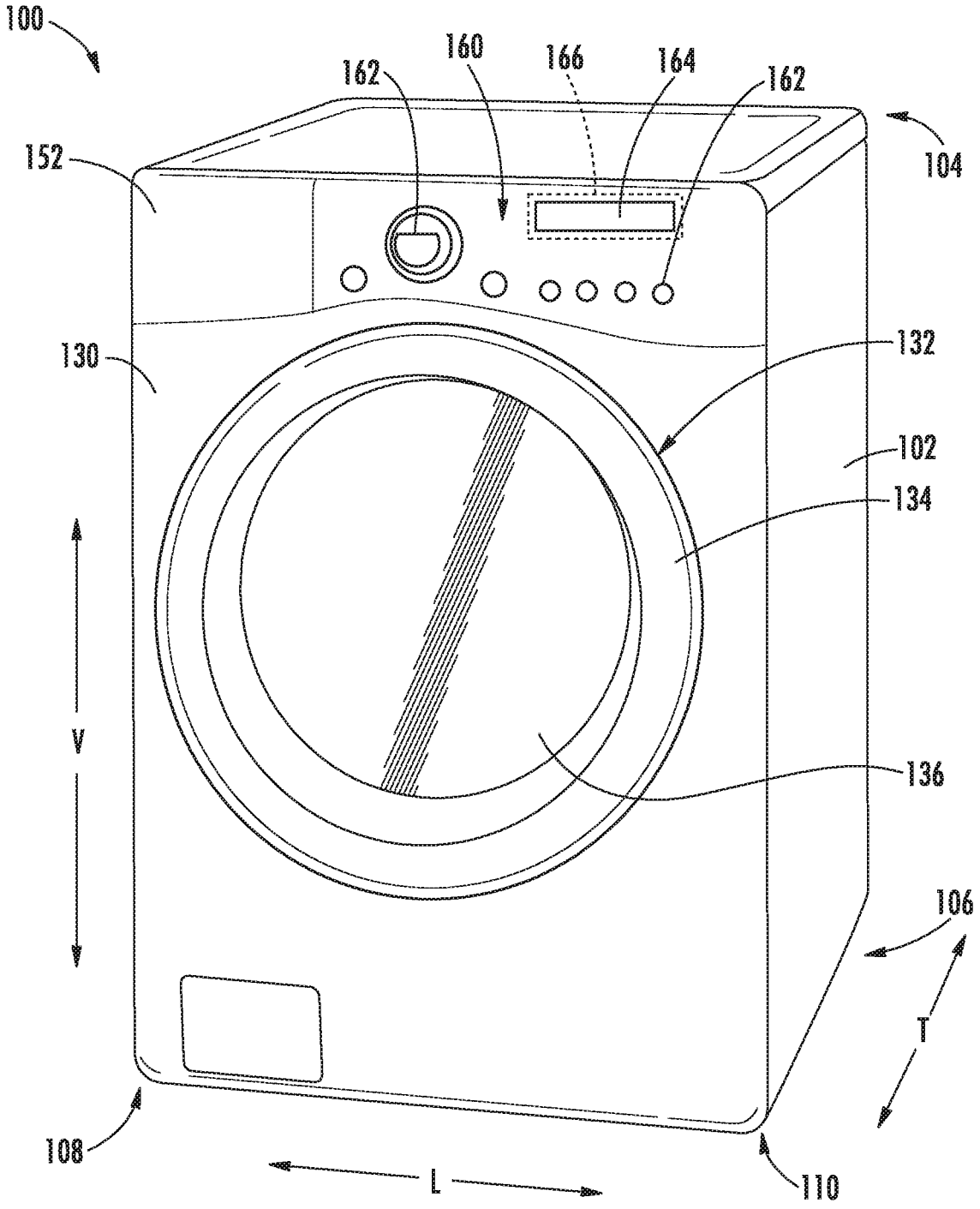
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements.

Figure 2:
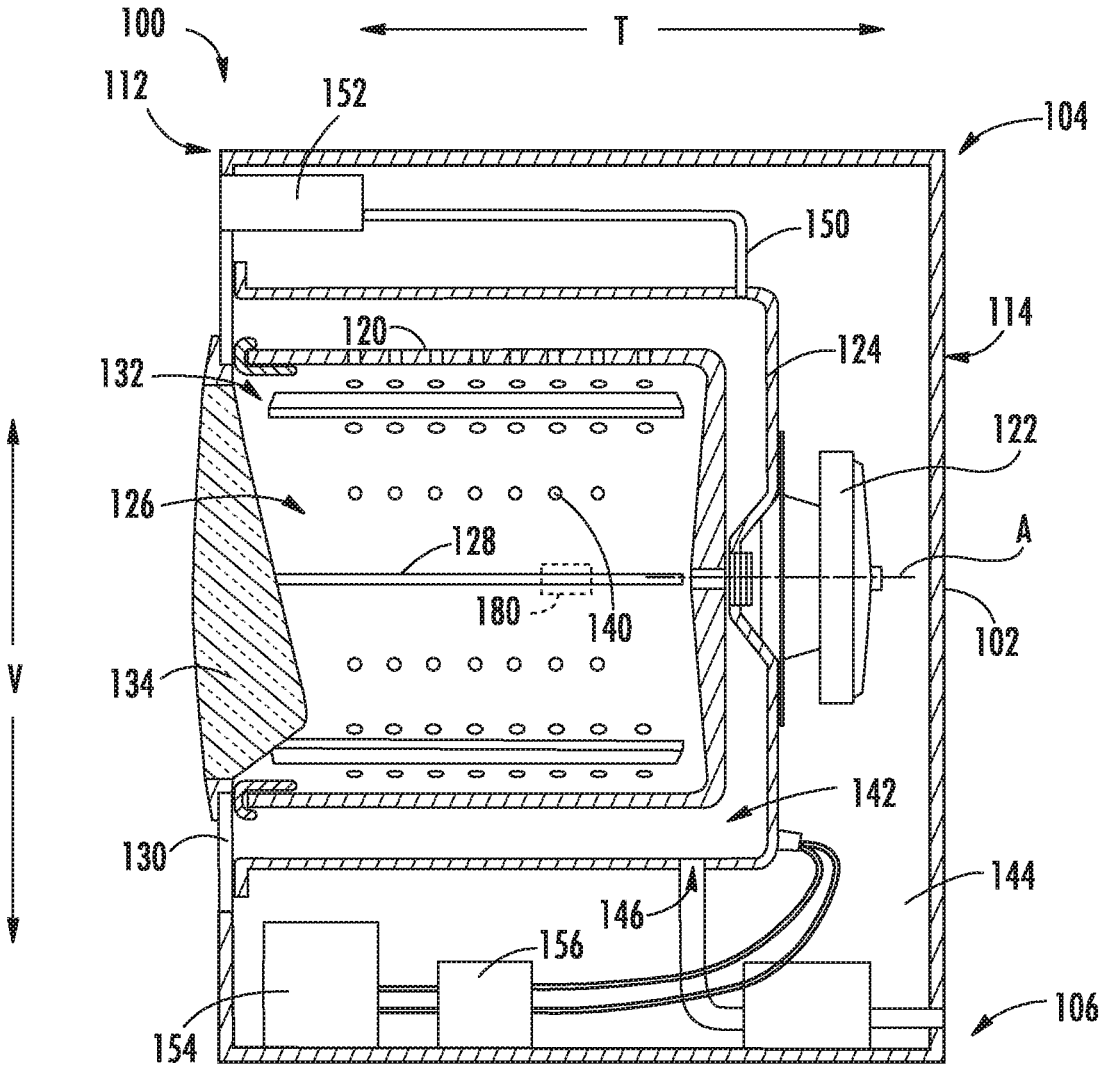
FIG. 2 provides a cross-sectional side view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Tub 124 is substantially fixed relative to cabinet 102 such that it does not generally rotate or translate relative to cabinet 102 (e.g., apart from vibrations or twisting indirectly induced by movement of other elements within cabinet 102).

A wash basket 120 is received within tub 124 and defines a wash chamber 126 that is configured for receipt of one or more articles for washing (e.g., as part of an article load). More specifically, wash basket 120 is rotatably mounted within tub 124 such that it is rotatable about a rotation axis A. According to the illustrated embodiment, the rotation axis A is substantially parallel to the transverse direction T. In this regard, washing machine appliance 100 is generally referred to as a "horizontal axis" or "front-loading" washing machine appliance 100. However, it should be appreciated that aspects of the present subject matter may be used within the context of other washing machine appliances or configurations as well.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation cycle, rinse cycle, spin cycle, etc.). In some embodiments, motor assembly 122 is configured to supply or generate discrete rotational impulses imparted to (e.g., directed to) wash basket 120. According to the illustrated embodiment, motor assembly 122 is a pancake motor. However, it should be appreciated that any suitable type, size, or configuration of motor may be used to rotate wash basket 120 according to alternative embodiments.

In some embodiments, cabinet 102 also includes a front panel 130 that defines an opening 132 that permits user access to wash basket 120 of tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a tub 124 and a closed position (FIG. 1) prohibiting access to tub 124.

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle may extend between tub 124 and the front panel 130 about the opening 132 covered by door 134, further sealing tub 124 from cabinet 102.

Referring again to FIG. 2, wash basket 120 also defines a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath tub 124 for gravity assisted flow when draining tub 124 (e.g., via a drain 146). Pump assembly 144 is also configured for recirculating wash fluid within tub 124.

Figure 3:
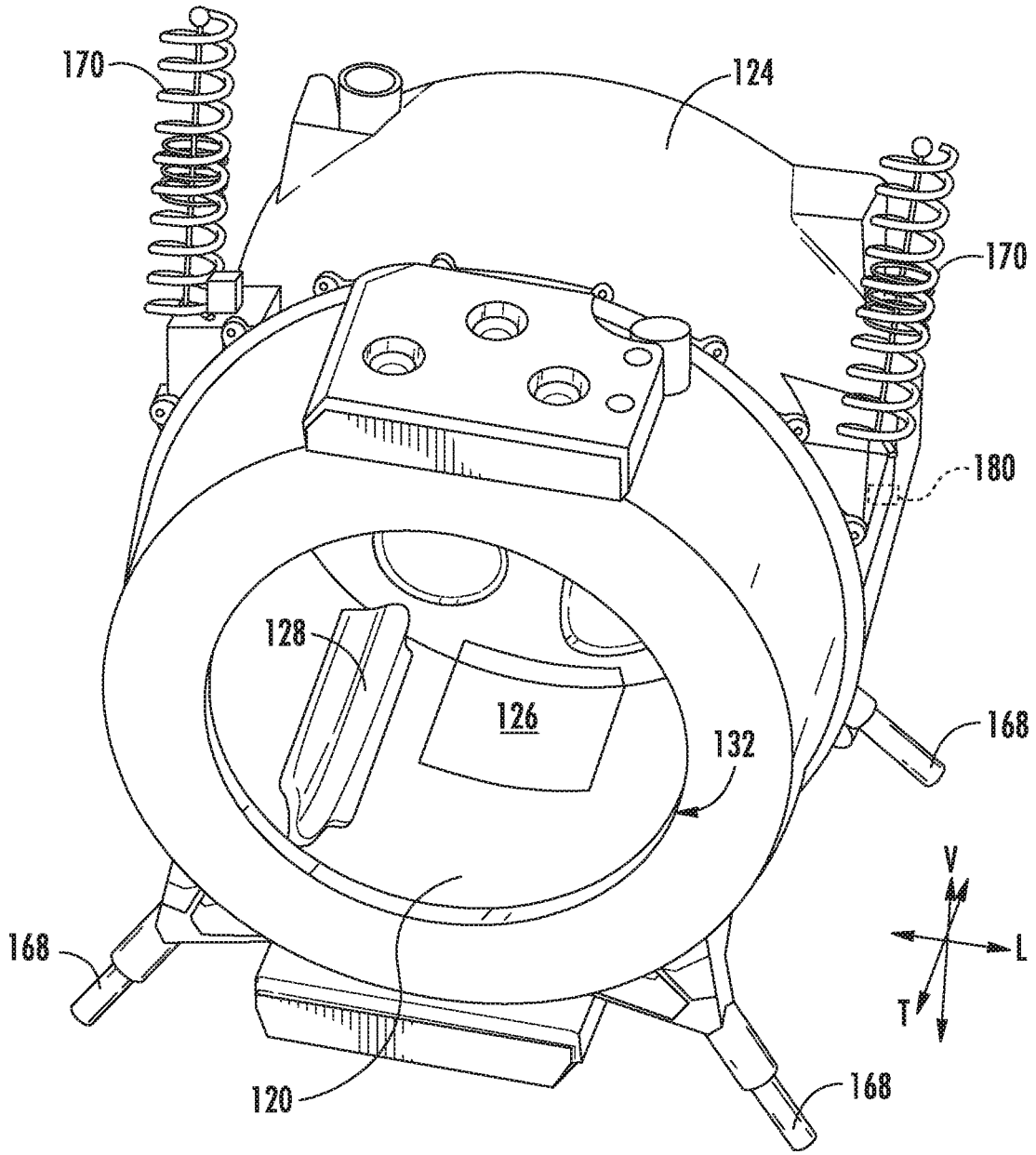
FIG. 3 provides a perspective view of a portion of the exemplary washing machine appliance of FIG. 1, wherein the cabinet has been removed for clarity.
Figure 4:
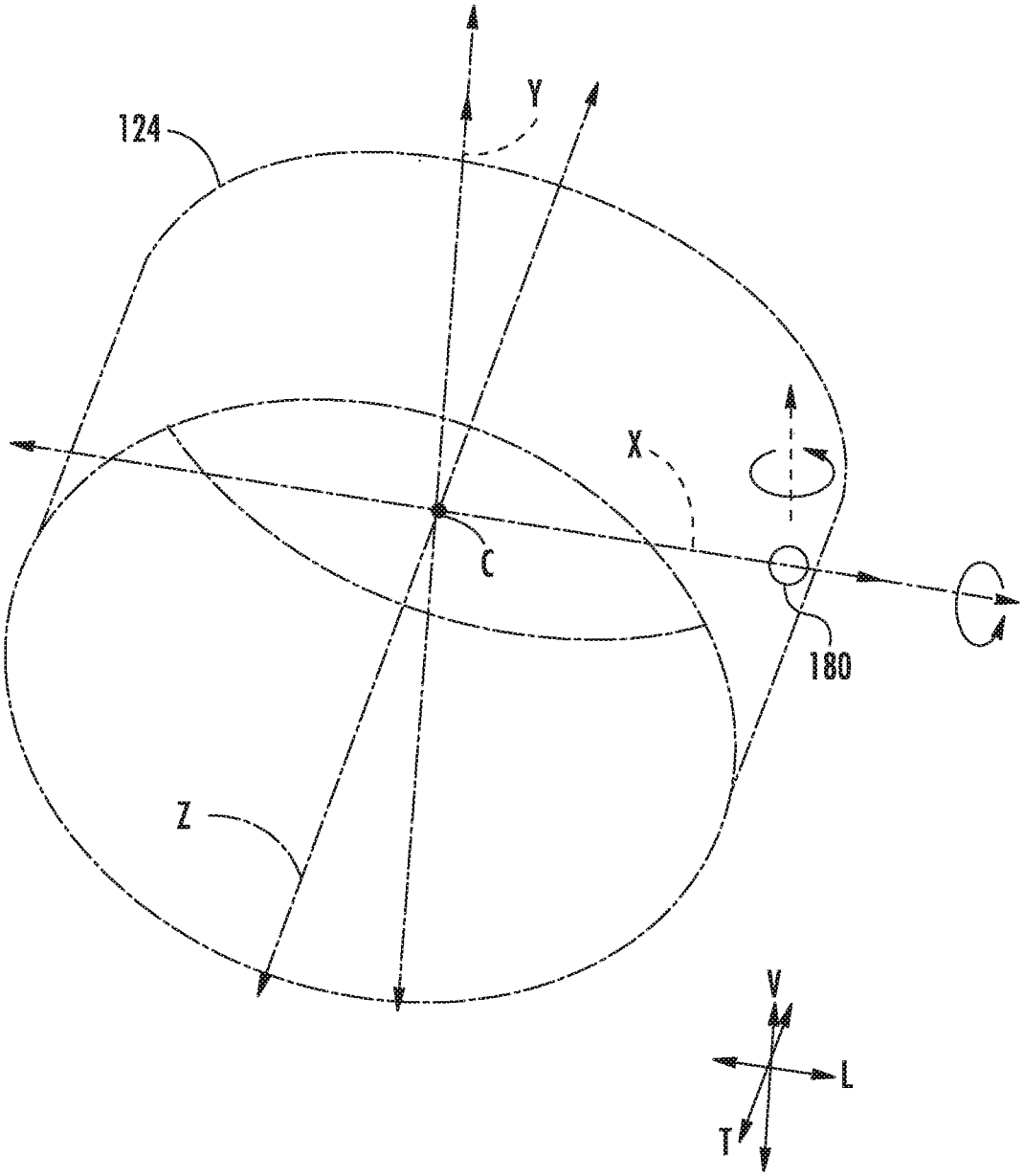
FIG. 4 provides a schematic perspective view of components of a washing machine appliance in accordance with exemplary embodiments of the present disclosure.
Figure 5:
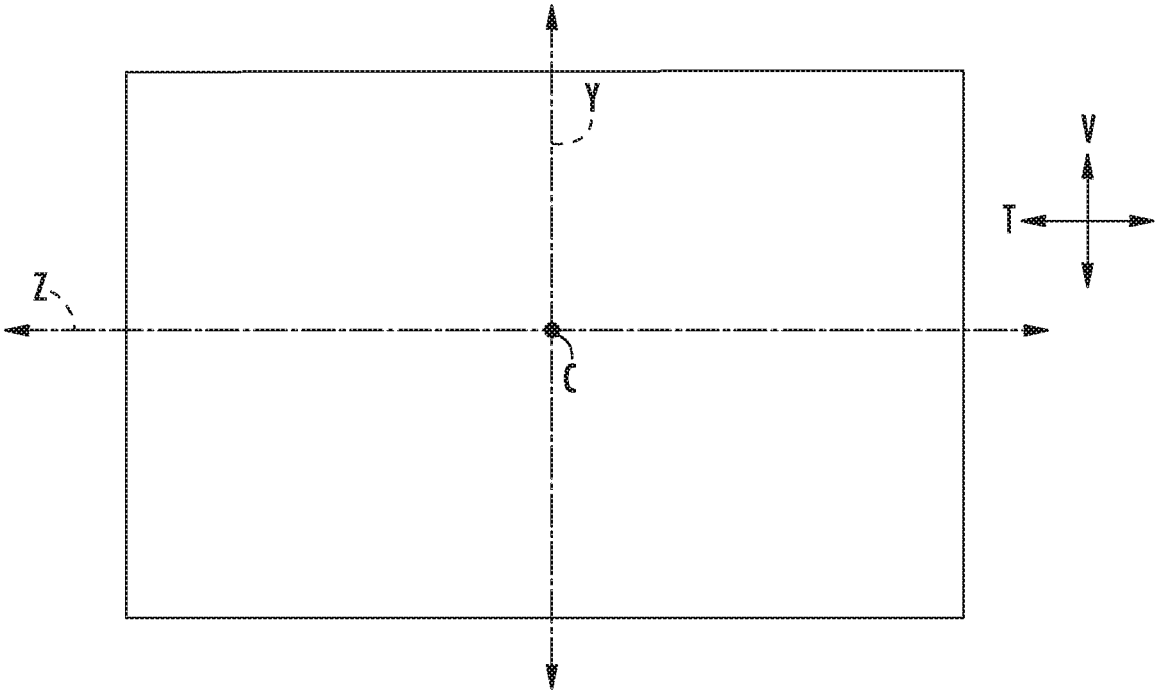
FIG. 5 provides a schematic side view of components of a washing machine appliance in accordance with exemplary embodiments of the present disclosure.
Figure 6:
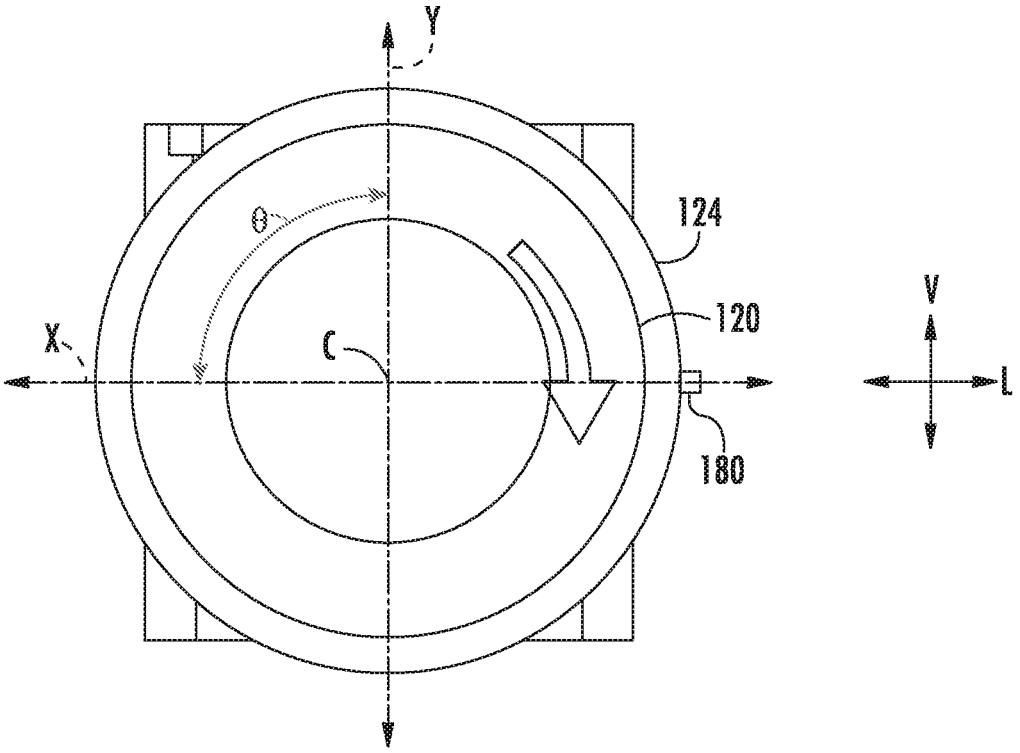
FIG. 6 provides a schematic from view of components of a washing machine appliance in accordance with exemplary embodiments of the present disclosure.

Turning briefly to FIG. 3, wash basket 120, tub 124, and machine drive system 148 are supported by a vibration damping system. The damping system generally operates to damp or reduce dynamic motion imparted to tub 124 as the wash basket 120 rotates within the tub 124. The damping system can include one or more damper assemblies 168 coupled between and to the cabinet 102 and tub 124 (e.g., at a bottom portion of tub 124). Typically, four damper assemblies 168 are utilized, and are spaced apart about the tub 124. For example, each damper assembly 168 may be connected at one end proximate to a bottom corner of the cabinet 102. Additionally or alternatively, the washer can include other vibration damping elements, such as one or more suspension assemblies 170 positioned above wash basket 120 and attached to tub 124 at a top portion thereof. In optional embodiments, the vibration damping system (and washing machine appliance 100, generally) is free of any annular balancing rings, which would add an evenly-distributed rotating mass on basket 120. Thus, the rotating mass of the wash basket 120 may be relatively low, advantageously reducing the amount of energy or torque required to rotate basket 120.

Returning to FIGS. 1 and 2, in some embodiments, washing machine appliance 100 includes an additive dispenser or spout 150. For example, spout 150 may be in fluid communication with a water supply (not shown) in order to direct fluid (e.g., clean water) into tub 124. Spout 150 may also be in fluid communication with the sump 142. For example, pump assembly 144 may direct wash fluid disposed in sump 142 to spout 150 in order to circulate wash fluid in tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to tub 124.

In exemplary embodiments, a control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a washing operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122 and measurement device 180 (discussed herein), may be in communication with controller 166 via one or more signal lines or shared communication busses. Optionally, measurement device 180 may be included with controller 166. Moreover, measurement devices 180 may include a microprocessor that performs the calculations specific to the measurement of motion with the calculation results being used by controller 166.

In exemplary embodiments, during operation of washing machine appliance 100, laundry items are loaded into wash basket 120 through opening 132, and a washing operation is initiated through operator manipulation of input selectors 162. For example, a wash cycle may be initiated such that tub 124 is filled with water, detergent, or other fluid additives (e.g., via additive dispenser 150). One or more valves (not shown) can be controlled by washing machine appliance 100 to provide for filling wash basket 120 to the appropriate level for the volume of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the wash basket 120 may be motivated about the rotation axis A at a set speed (e.g., first speed or tumble speed). As the wash basket 120 is rotated, articles within the wash basket 120 may be lifted and permitted to drop therein.

Figure 9:
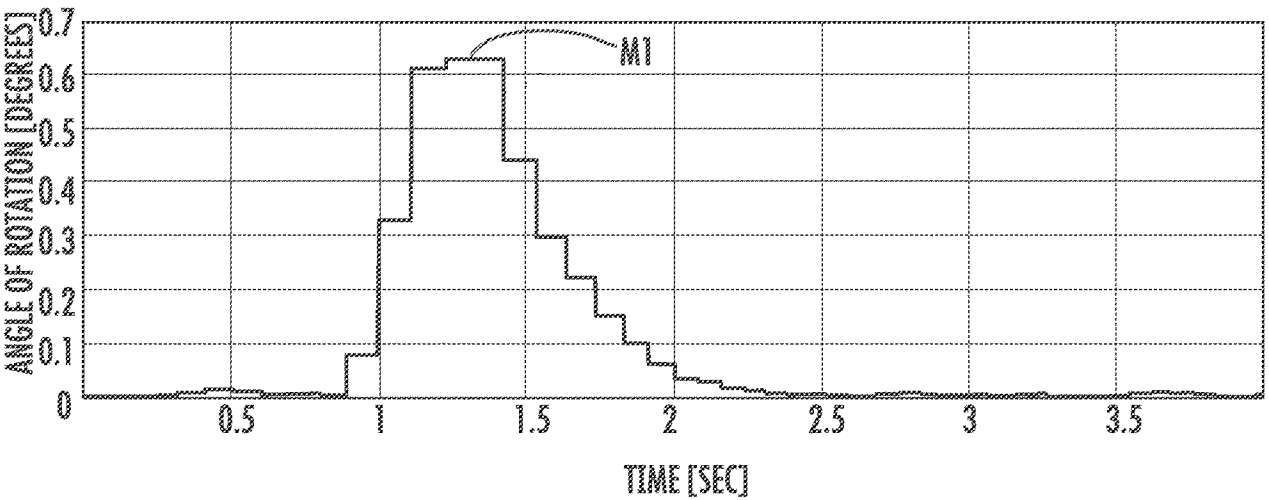
FIG. 9 provides an exemplary measurement chart rotational displacement of a tub over time for a first load in accordance with embodiments of the present disclosure.
Figure 10:
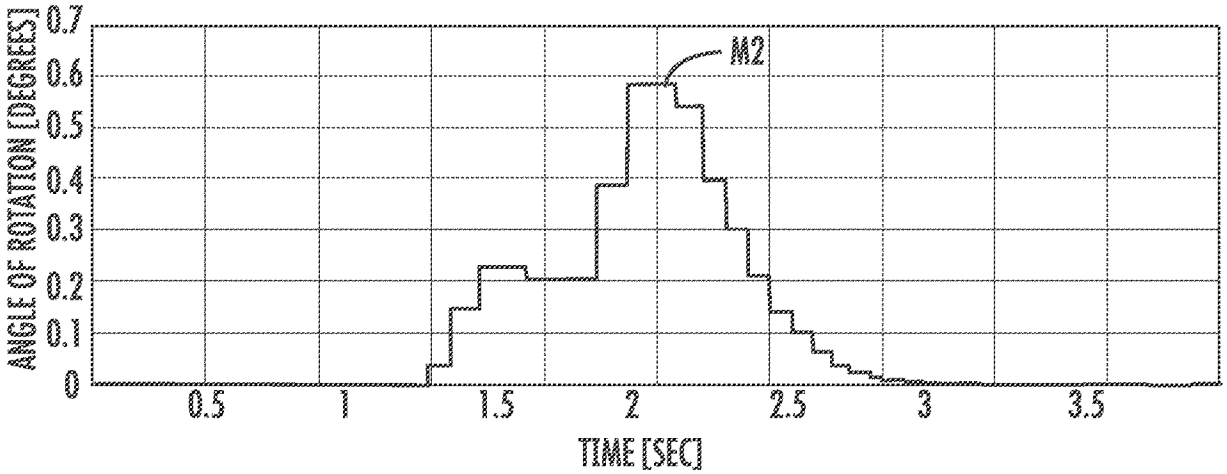
FIG. 10 provides an exemplary measurement chart illustrating rotational displacement of a tub over time for a second load in accordance with embodiments of the present disclosure.
Figure 11:
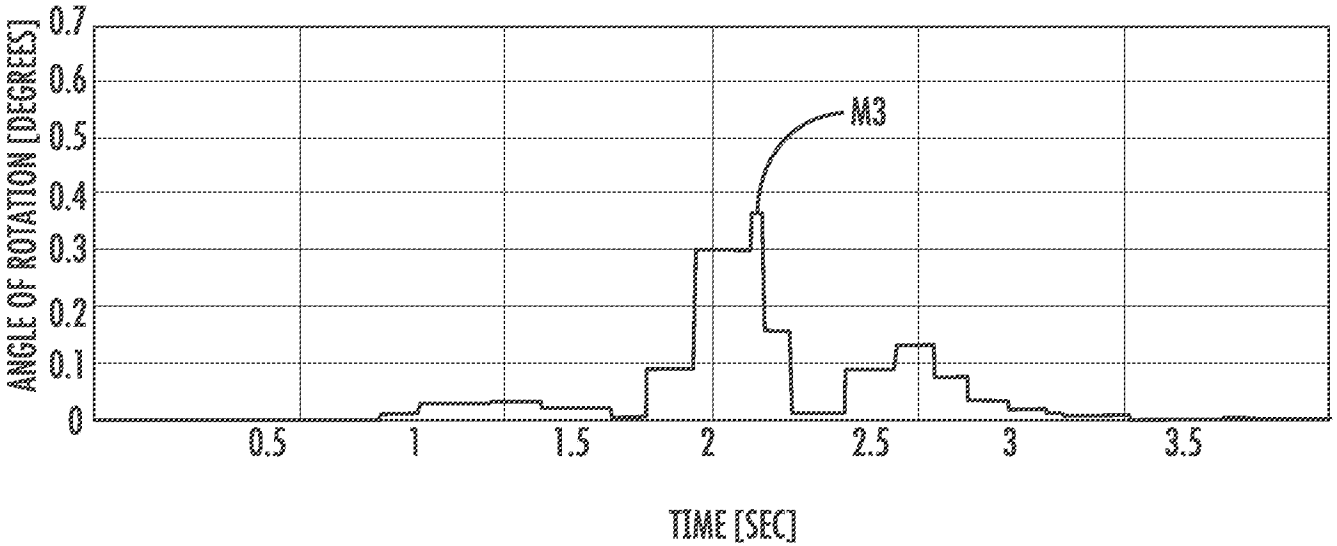
FIG. 11 provides an exemplary measurement chart illustrating rotational displacement of a tub over time for a third load in accordance with embodiments of the present disclosure.
Figure 12:
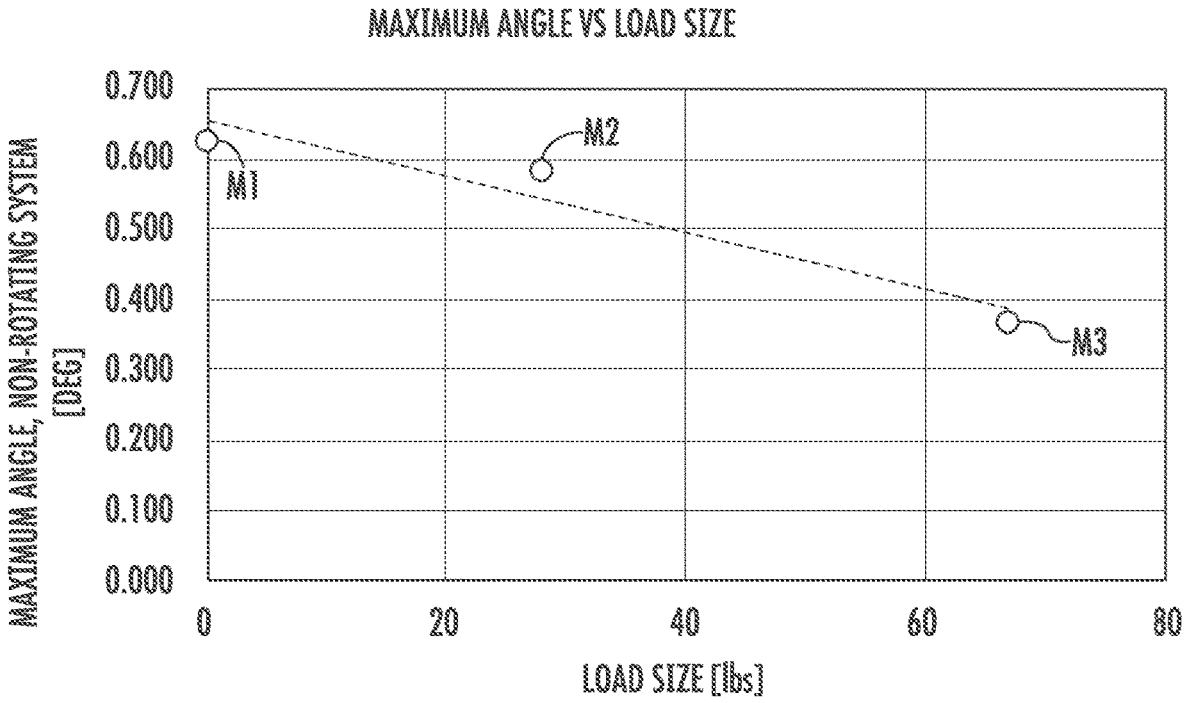
FIG. 12 provides an exemplary measurement chart illustrating a maximum rotational displacement of a tub relative to load size in accordance with embodiments of the present disclosure.

Prior or subsequent to filling tub 124 with water, detergent, or other fluid additives; washing machine appliance 100 may determine how large the load is within wash basket 120. In other words, washing machine appliance 100 may determine a load size of the article load within wash basket. For instance, a discrete rotational impulse may be directed or applied to wash basket 120 (e.g., through motor assembly 122). The discrete rotational impulse may have a predetermined value or magnitude (e.g., in pound-seconds or lbf*s) Prior to applying the discrete impulse, wash basket 120 may be static (e.g., such that wash basket 120 is not rotating and is stationary relative to the rotation axis A). Immediately after the discrete rotational impulse is applied, displacement of tub 124 may be measured (e.g., at a measurement device 180). In some such embodiments, a displacement angle θ about the rotation axis A is measured. The ultimate determination of load size may be based on the measured displacement angle θ. For instance, turning briefly to FIGS. 9 through 12, as illustrated, displacement of the tub 124 (FIG. 3) about the rotation axis A may be observed as corresponding to load size. For instance, FIGS. 9, 10, and 11 illustrate a measured response of the tub 124 in response to a relatively small-mass load, medium-mass load, and large-mass load, respectively. As load size increases, for example, a maximum angle M1, M2, M3 of displacement following application of a discrete rotational impulse may be affected. In some such embodiments, a maximum angle of displacement generally decreases as the load size increases, as illustrated in FIG. 12.

Returning generally to FIGS. 1 through 6, after the agitation phase of the washing operation is completed, tub 124 can be drained. Laundry articles can then be rinsed (e.g., through a rinse cycle) by again adding fluid to tub 124 (e.g., depending on the particulars of the cleaning cycle selected by a user or the determined load size). Ribs 128 may again provide agitation within wash basket 120. One or more spin cycles may also be used. In particular, a spin cycle may be applied after the wash cycle or after the rinse cycle in order to wring wash fluid from the articles being washed.

After articles disposed in wash basket 120 are cleaned (or the washing operation otherwise ends), a user can remove the articles from wash basket 120 (e.g., by opening door 134 and reaching into wash basket 120 through opening 132).

Referring now to FIGS. 3 through 6, one or more measurement devices 180 may be provided in the washing machine appliance 100 for measuring movement of the tub 124, in particular during rotation of articles in the spin cycle of the washing operation. Measurement devices 180 may measure a variety of suitable variables that can be correlated to movement of the tub 124. The movement measured by such devices 180 can be utilized to monitor the load size of articles within tub 124 and to facilitate the amount of water or wash fluid (e.g., water, wash additive, etc.) directed to the tub 124 (e.g., during a wash cycle or rinse cycle).

A measurement device 180 in accordance with the present disclosure may include an accelerometer, which measures translational motion, such as acceleration along one or more directions. Additionally or alternatively, a measurement device 180 may include a gyroscope, which measures rotational motion, such as rotational velocity about an axis. A measurement device 180 in accordance with the present disclosure is mounted to the tub 124 (e.g., on a sidewall of tub 124) to sense movement of the tub 124 relative to the cabinet 102 or rotation axis A by measuring uniform periodic motion, non-uniform periodic motion, or excursions of the tub 124 during appliance 100 operation. For instance, movement may be measured as discrete identifiable components (e.g., in a predetermined direction).

In exemplary embodiments, a measurement device 180 may include at least one gyroscope or at least one accelerometer. The measurement device 180, for example, may be a printed circuit board that includes the gyroscope and accelerometer thereon. The measurement device 180 may be mounted to the tub 124 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to the tub 124 at a single location (e.g., the location of the printed circuit board or other component of the measurement device 180 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on tub 124 can measure the rotation of an accelerometer located at a different location on tub 124, because rotation about a given axis is the same everywhere on a solid object such as tub 124.

Additionally or alternatively, the measurement device 180 may include another suitable sensor or device for measuring movement of the tub 124. For instance, the measurement device 180 may be provided as or include an optical sensor, an inductive sensor, an ultrasonic sensor, etc.

As illustrated, tub 124 may define an X-axis, a Y-axis, and a Z-axis that are mutually orthogonal to each other. The Z-axis may extend along a longitudinal direction and may thus be coaxial or parallel with the rotation axis A (FIG. 2) (e.g., when the tub 124 and wash basket 120 are balanced). Movement of the tub 124 measured by measurement device (s) 180 can, in exemplary embodiments, be measured (e.g., approximately measured) as a displacement angle θ about the Z-axis or rotation axis A.

In further embodiments, movement is measured as a plurality of unique displacements values (e.g., displacement angles). Optionally, the displacement values may occur in one or more channels of motion (e.g., as distinct directional components of movement). For instance, displacement values may correspond to one or more indirectly measured movement components about a center C (e.g., geometric center of gravity based on the shape and mass of tub 124 in isolation) of the tub 124. Such movement components may, for example, occur in a plane defined by the X-axis and Y-axis (i.e., the X-Y plane). Movement of the tub 124 along or about a particular axis may be calculated using the indirect measurement component and other suitable variables, such as a horizontal or radial offset distance along the vector from the measurement device 180 to the center C of the tub 124. Additionally or alternatively, the displacement values may correspond to one or more directly measured movement components. Such movement components may, for example, occur in the X-Y plane.

The measured movement of the tub 124 in accordance with exemplary embodiments of the present disclosure, such as those requiring one or more gyroscopes and one or more accelerometers, may advantageously be calculated based on the movement components measured by the accelerometer or gyroscope of the measurement device(s) 180. In exemplary embodiments, a movement component of the tub 124 includes or is provided as a displacement value θ for angular displacement of the tub 124. Displacement angle θ may represent rotation relative to the Z-axis or rotation axis A (FIG. 2), such as the angle of deviation of the X-axis or Y-axis from its static or balanced position relative to the rotation axis A.

Figure 7:
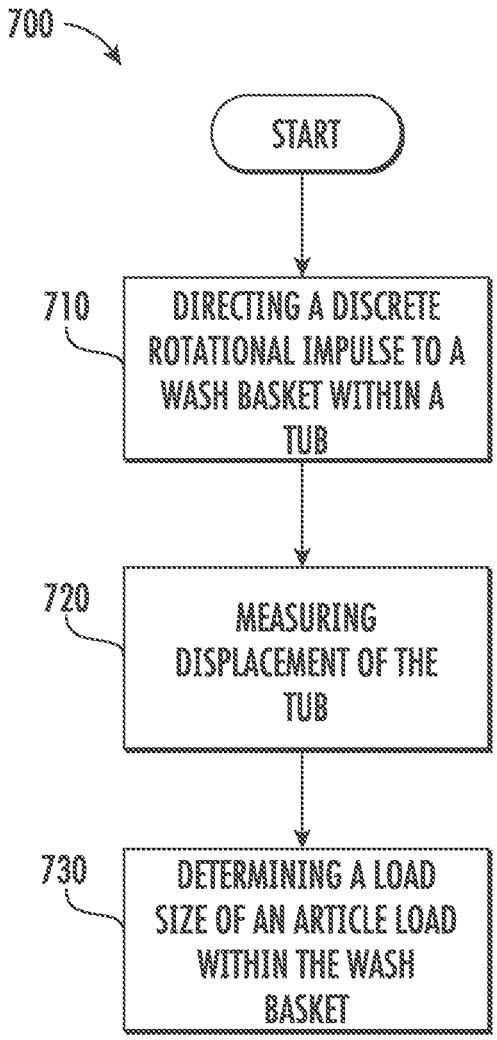
FIG. 7 provides a flow chart illustrating a method of operating a washing machine appliance according to exemplary embodiments of the present disclosure.
Figure 8:
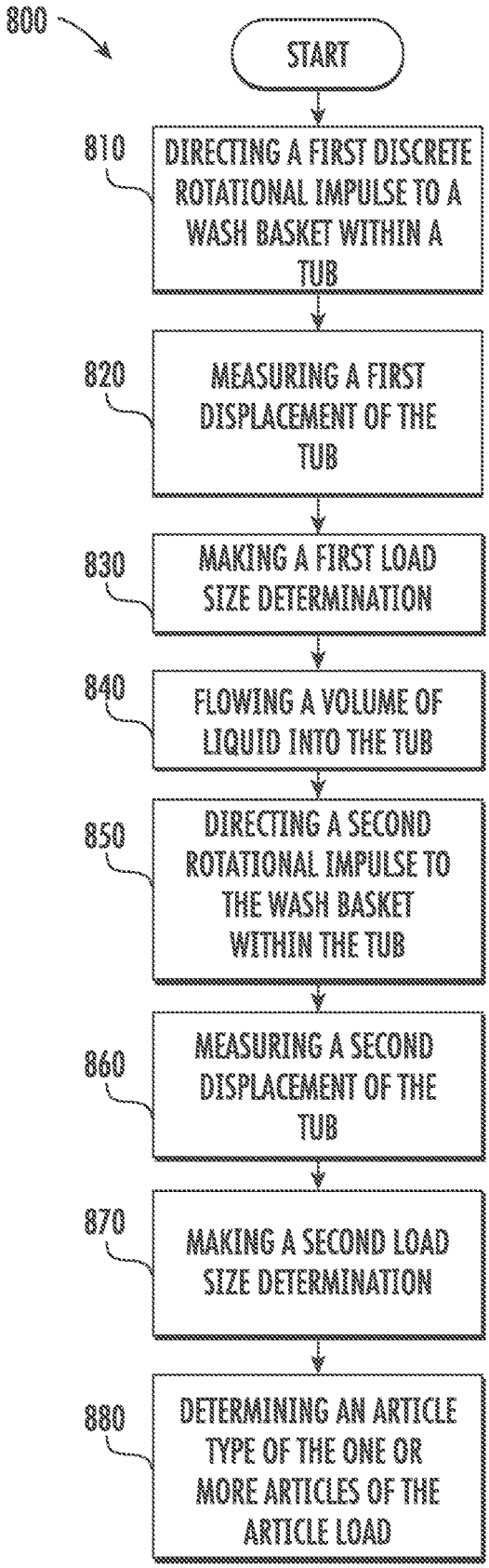
FIG. 8 provides a flow chart illustrating a method of operating a washing machine appliance according to exemplary embodiments of the present disclosure.

Referring now to FIGS. 7 and 8, various methods may be provided for use with washing machine appliances in accordance with the present disclosure. In general, the various steps of methods as disclosed herein may, in exemplary embodiments, be performed by the controller 166, which may receive inputs and transmit outputs from various other components of the appliance 100. In particular, the present disclosure is further directed to methods, as indicated by reference numbers 700 and 800, for operating a washing machine appliance 100. Such methods advantageously facilitate determination of the load size (e.g., without a direct estimate or input of the load size by the user). In particular, such methods may advantageously permit the automatic determination of load size without requiring an even distribution of articles within the wash basket 120 or requiring plastering of the articles of the load against the wall(s) of the wash basket 120. Moreover, such methods may advantageously reduce the time in which a load size may be determined and, for example, thereby reduce the total time required for a given wash cycle.

FIGS. 7 and 8 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure. Moreover, although described separately with respect to FIGS. 7 and 8, is understood that the methods 700 and 800 are not mutually exclusive and may include one or more steps of the other.

Turning especially to FIG. 7, at 710, the method 700 includes directing a discrete rotational impulse to the wash basket. In particular, the discrete rotational impulse (e.g., having a predetermined value in units of impulse, such as lbf*s) through the motor assembly in mechanical communication with the wash basket. For instance, the discrete rotational impulse may be directed to the wash basket such that the wash basket is caused to rotate in a first direction (e.g., clockwise or, alternatively, counter-clockwise direction) about the rotation axis.

In some embodiments, 710 is initiated in response to selection of a washing operation (e.g., by a user at the user interface of the washing machine appliance). Generally, 710 is performed as part of a washing operation (e.g., prior to any spin cycle) for a specific or discrete article load within the wash basket of the washing machine appliance.

In certain embodiments, 710 occurs prior to any liquid being flowed to the tub for the corresponding washing operation. Thus, the wash basket (and articles or load therein) may be generally dry and the method 700 may include flowing a volume of liquid into the tub subsequent to 710. In alternative embodiments, 710 occurs subsequent to a volume of liquid being flowed into the tub. Thus, the method 700 may include flowing a volume of liquid into the tub prior to the discrete rotational impulse. Moreover, the predetermined rotational impulse may be predetermined to rotate the wash basket less than 180° (e.g., when empty such that no articles or liquid are held within the wash basket) in a first direction about the Z-axis or rotation axis. For instance, the first direction may be generally defined in a clockwise or, alternatively, counter-clockwise direction.

At 720, the method 700 includes measuring displacement of the tub at a measurement device mounted to the tub, as described above. Measurement at 720 may occur after 710. In other words, displacement of the tub may be measured following (e.g., immediately after or in response to) directing the discrete rotational impulse. Thus, the measurement at 720 may assess the displacement effects on the tub caused by the discrete rotational impulse at 710. In certain embodiments, measuring displacement at 720 includes measuring a displacement angle (e.g., about the Z-axis or rotation axis of the wash basket). In some such embodiments, the displacement angle measured at 720 is defined in a second direction that is opposite from the first direction about the Z-axis or rotation axis. For instance, the second direction may be generally defined in a counter-clockwise or, alternatively, clockwise direction.

In exemplary embodiments, the displacement angle measured at 720 is a maximum angle of rotation (e.g., about the Z-axis or rotation axis of the wash basket). In particular, the displacement angle may be a maximum angle of displacement about the Z-axis or rotation axis relative to a static or stationary position of the tub prior to 710 or any movement of the wash basket during a washing operation. A predetermined time period (e.g., less than or equal to 10 seconds) following 710 may be provided in which to measure the displacement angle at 720. Thus, the displacement angle may be a maximum angle of displacement about the Z-axis or rotation axis within a predetermined time period following directing the discrete rotational impulse.

At 730, the method 700 includes determining a load size of the article load within the wash basket based on the measured displacement at 720. For instance, the load size may be provided as a relative classification (e.g., small, medium, large, extra-large, etc.) or, alternatively, as a specific value (e.g., in pounds). In some embodiments, a predetermined correlation is provided (e.g., based on prior testing data) that relates displacement magnitude to load size. The predetermined correlation may be provided as, for instance, a programmed correlation table, formula, or chart. In further embodiments, 730 may include comparing a magnitude of the displacement angle from 720 to the predetermined correlation. As would be understood, determining the load size may affect various portions of the washing operation, such as, for example, the amount or volume of water or wash fluid flowed into the tub during one or more portions of the same washing operation.

In optional embodiments, the method 700 provides for multiple discrete rotational impulses and corresponding measurements. For instance, the rotational impulse at 710 may be a first rotational impulse, and the measured displacement at 720 is a first measured displacement. In some such embodiments, 710 and 720 occur while the wash basket is generally dry. The method 700 may thus include flowing a volume of liquid into the tub subsequent to (i.e., after) 710 and 720. A second rotational impulse (e.g., equal to or unique from the first rotational impulse) may be directed to the wash basket (e.g., through the motor assembly) subsequent to flowing the volume of liquid into the tub (e.g., such that the articles or load are suitably wet during the second rotational impulse), and then measuring a second displacement of the tub following the second rotational impulse. Based on the second displacement (e.g., magnitude thereof), a second load size determination may be made (e.g., using the predetermined correlation from 730 or, alternatively, a second unique predetermined correlation). The second load size determination may supersede or replace the first load size determination (e.g., to set the load size for the remainder of the washing operation).

Additionally or alternatively, a dry correlation may be provided for the first load size determination (i.e., at 730), while a separate wet correlation may be provided for the second load size determination. In optional embodiments, the first and second displacements are used as the basis for a determination of an article type (e.g., cottons, delicates, mixed load, etc.) of the one or more articles of the article load. For instance, a type correlation (e.g., in the form of a programmed table, formula, or chart) may be provided such that the controller of the washing machine appliance may automatically determine the appropriate article type setting (e.g., to thereby determine or set a suitable agitation speed, spin speed, or discrete cycles of the washing operation).

Turning especially to FIG. 8, at 810, the method 800 includes directing a first rotational impulse to the wash basket within the tub. In particular, the first rotational impulse (e.g., having a predetermined value in units of impulse, such as lbf*s) through the motor assembly in mechanical communication with the wash basket. For instance, the first rotational impulse may be directed to the wash basket such that the wash basket is caused to rotate in a first direction (e.g., clockwise or, alternatively, counter-clockwise direction) about the Z-axis or rotation axis. Moreover, the first rotational impulse may be predetermined to rotate the wash basket less than 180° (e.g., when empty such that no articles or liquid are held within the wash basket).

In some embodiments, 810 is initiated in response to selection of a washing operation (e.g., by a user at the user interface of the washing machine appliance). Generally, 810 is performed as part of a washing operation (e.g., prior to any spin cycle) for a particular or discrete article load within the wash basket of the washing machine appliance. Moreover, 810 occurs prior to any liquid being flowed to the tub for the corresponding washing operation. Thus, the wash basket (and articles or load therein) may be generally dry during 810.

At 820, the method 800 includes measuring a first displacement of the tub (e.g., at a measurement device mounted to the tub, as described above). Measurement at 820 occurs after 810. In other words, displacement of the tub may be measured following (e.g., immediately after or in response to) directing the first rotational impulse. Thus, the measurement at 820 may assess the displacement effects on the tub caused by the first rotational impulse at 810. In certain embodiments, measuring displacement at 820 includes measuring a displacement angle (e.g., about the Z-axis or rotation axis of the wash basket). In some such embodiments, the displacement angle measured at 820 is defined in a second direction that is opposite from the first direction about the Z-axis or rotation axis. For instance, the second direction may be generally defined in a counter-clockwise or, alternatively, clockwise direction.

In exemplary embodiments, the displacement angle measured at 820 is a maximum angle of rotation (e.g., about the Z-axis or rotation axis of the wash basket). In particular, the displacement angle may be a maximum angle of displacement about the Z-axis or rotation axis relative to a static or stationary position of the tub prior to 810 or any movement of the wash basket during a washing operation. A predetermined time period (e.g., less than or equal to 10 seconds) following 810 may be provided in which to measure the displacement angle at 820. Thus, the displacement angle may be a maximum angle of displacement about the Z-axis or rotation axis within a predetermined time period following directing the first rotational impulse.

At 830, the method 800 includes making a first load size determination. In particular, the determination at 830 may provide a first determination for the article load within the wash basket based on the measured displacement at 820. For instance, the load size may be provided as a relative classification (e.g., small, medium, large, extra-large, etc.) or, alternatively, as a specific value (e.g., in pounds). In some embodiments, a predetermined first correlation is provided (e.g., based on prior testing data) that relates a dry displacement magnitude to load size. The predetermined first correlation may be provided as, for instance, a programmed correlation table, formula, or chart. In further embodiments, 830 includes comparing a magnitude of the displacement angle from 820 to the first correlation.

As would be understood, determining the load size may affect various portions of the washing operation, such as, for example, the amount or volume of water or wash fluid flowed into the tub during one or more portions of a corresponding washing operation (i.e., the same washing operation).

At 840, the method 800 includes flowing a volume of liquid into the tub. The liquid may include water, and may further include one or more additives as discussed above. The water may be flowed through the hoses and nozzle assembly into the tub and onto articles that are disposed in the wash basket for washing. In optional embodiments, the volume of liquid is dependent upon the determination at 830 or other variables that may, for example, be input by a user interacting with control panel and input selectors thereof.

At 850, the method 800 includes directing a second rotational impulse to the wash basket within the tub. In particular, the second rotational impulse (e.g., having a predetermined value in units of impulse, such as lbf's, that is equal to or, alternatively, unique from the first rotational impulse) through the motor assembly in mechanical communication with the wash basket. For instance, the second rotational impulse may be directed to the wash basket such that the wash basket is caused to rotate in the first direction (e.g., clockwise or, alternatively, counter-clockwise direction) about the rotation axis. Moreover, the second rotational impulse may be predetermined to rotate the wash basket less than 180° (e.g., when empty).

In some embodiments, 850 is initiated in response to initiation or completion of 840. Alternatively, one or more cycles (e.g., agitation cycles, spin cycles, drain cycles, etc.) may occur between 840 and 850.

At 860, the method 800 includes measuring a second displacement of the tub (e.g., at the measurement device mounted to the tub, as described above). Measurement at 860 occurs after 850. In other words, displacement of the tub may be measured following (e.g., immediately after or in response to) directing the second rotational impulse. Thus, the measurement at 860 may assess the displacement effects on the tub caused by the first rotational impulse at 850. In certain embodiments, measuring displacement at 860 includes measuring a displacement angle (e.g., about the Z-axis or rotation axis of the wash basket). In some such embodiments, the displacement angle measured at 860 is defined in the second direction that is opposite from the first direction about the Z-axis or rotation axis.

In exemplary embodiments, the displacement angle measured at 860 is a maximum angle of rotation (e.g., about the Z-axis or rotation axis of the wash basket). In particular, the displacement angle may be a maximum angle of displacement about the Z-axis or rotation axis relative to a static or stationary position of the tub prior to 810 or any movement of the wash basket during a washing operation. A predetermined time period (e.g., less than or equal to 10 seconds) following 850 may be provided in which to measure the displacement angle at 860. Thus, the displacement angle may be a maximum angle of displacement about the Z-axis or rotation axis within a predetermined time period following directing the second rotational impulse.

At 870, the method 800 includes making a second load size determination. In particular, the determination at 870 may provide a second determination for the article load within the wash basket based on the measured displacement at 860. For instance, the load size may be provided as a relative classification (e.g., small, medium, large, extra-large, etc.) or, alternatively, as a specific value (e.g., in pounds). In some embodiments, a predetermined second correlation is provided (e.g., based on prior testing data) that relates a wet displacement magnitude to load size. The predetermined second correlation may be provided as, for instance, a programmed correlation table, formula, or chart. In further embodiments, 870 includes comparing a magnitude of the displacement angle from 860 to the second correlation.

At 880, the method 800 includes determining an article type of the articles of the article load. For instance, the first and second displacements (i.e., measured at 820 and 860, respectively) may be used as the basis for a determination of an article type (e.g., cottons, delicates, mixed load, etc.) of the one or more articles of the article load. For instance, a type correlation (e.g., in the form of a programmed table, formula, or chart) may be provided such that the controller of the washing machine appliance may automatically determine the appropriate article type setting (e.g., to thereby determine or set a suitable agitation speed, spin speed, or discrete cycles of the washing operation).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a tub and a wash basket rotatably mounted therein to receive an article load of one or more articles, the method comprising:

directing a discrete rotational impulse to the wash basket through a motor in mechanical communication with the wash basket, the discrete rotational impulse being a first rotational impulse;

measuring displacement of the tub at a measurement device to detect movement of the tub, measuring displacement following directing the discrete rotational impulse, the measured displacement being a first displacement;

determining a load size of the article load based on the measured displacement;

flowing a volume of liquid into the tub subsequent to directing the first rotational impulse;

directing a second rotational impulse to the wash basket through the motor subsequent to flowing the volume of liquid into the tub; and measuring a second displacement of the tub following directing the second rotational impulse.

2. The method of claim 1, wherein measuring displacement of the tub comprises measuring a displacement angle about a rotation axis of the wash basket.

3. The method of claim 2, wherein the discrete rotational impulse initiates rotation of the wash basket in a first direction about the rotation axis, and wherein the displacement angle is defined in a second direction opposite the first direction about the rotation axis.

4. The method of claim 2, wherein determining the load size comprises comparing a magnitude of the displacement angle to a predetermined correlation relating displacement magnitude to load size.

5. The method of claim 2, wherein the displacement angle is a maximum angle of displacement about the rotation axis within a predetermined time period following directing the discrete rotational impulse.

6. The method of claim 1, wherein the method further comprises:

flowing a volume of liquid into the tub prior to directing the discrete rotational impulse.

7. The method of claim 1, further comprising:

determining an article type of the one or more articles of the article load based on the first displacement and the second displacement.

8. A washing machine appliance defining a vertical direction, a lateral direction, and a transverse direction, the washing machine appliance comprising:

a cabinet including a front panel, the front panel defining an opening;

a tub positioned within the cabinet;

a wash basket rotatably mounted within the tub, the wash basket defining a wash chamber to receive an article load of one or more articles;

a measurement device to detect movement of the tub;

a motor in mechanical communication with the wash basket to selectively rotate the wash basket within the tub; and a controller in operative communication with the measurement device and the motor, the controller being configured to initiate a washing operation, the washing operation comprising directing a discrete rotational impulse to the wash basket through the motor, the discrete rotational impulse being a first rotational impulse, measuring displacement of the tub at the measurement device, measuring displacement following directing the discrete rotational impulse, the measured displacement being a first displacement, determining a load size of the article load based on the measured displacement, flowing a volume of liquid into the tub subsequent to directing the first rotational impulse, directing a second rotational impulse to the wash basket through the motor subsequent to flowing the volume of liquid into the tub, and measuring a second displacement of the tub following directing the second rotational impulse.

9. The washing machine appliance of claim 8, wherein measuring displacement of the tub comprises measuring a displacement angle about a rotation axis of the wash basket.

10. The washing machine appliance of claim 9, wherein the discrete rotational impulse initiates rotation of the wash basket in a first direction about the rotation axis, and wherein the displacement angle is defined in a second direction opposite the first direction about the rotation axis.

11. The washing machine appliance of claim 9, wherein determining the load size comprises comparing a magnitude of the displacement angle to a predetermined correlation relating displacement magnitude to load size.

12. The washing machine appliance of claim 9, wherein the displacement angle is a maximum angle of displacement about the rotation axis within a predetermined time period following directing the discrete rotational impulse.

13. The washing machine appliance of claim 8, wherein the washing operation further comprises flowing a volume of liquid into the tub prior to directing the discrete rotational impulse.

14. The washing machine appliance of claim 8, wherein the washing operation further comprises determining an article type of the one or more articles of the article load based on the first displacement and the second displacement.

15. A method for operating a washing machine appliance, the washing machine appliance having a tub and a wash basket rotatably mounted therein to receive an article load of one or more articles, the method comprising:

directing a first rotational impulse to the wash basket through a motor in mechanical communication with the wash basket;

measuring a first displacement of the tub at a measurement device to detect movement of the tub, measuring displacement following directing the discrete rotational impulse;

determining a load size of the article load based on the measured displacement;

flowing a volume of liquid into the tub subsequent to directing the first rotational impulse;

directing a second rotational impulse to the wash basket through the motor subsequent to flowing the volume of liquid into the tub;

measuring a second displacement of the tub following directing the second rotational impulse; and determining an article type of the one or more articles of the article load based on the first displacement and the second displacement.

16. The method of claim 15, wherein measuring the first displacement of the tub comprises measuring a first displacement angle about a rotation axis of the wash basket, and wherein measuring the second displacement of the tub comprises measuring a second displacement angle about the rotation axis of the wash basket.

17. The method of claim 16, wherein the first rotational impulse initiates rotation of the wash basket in a first direction about the rotation axis, wherein the first displacement angle is defined in a second direction opposite the first direction about the rotation axis, wherein the second rotational impulse initiates rotation of the wash basket in the first direction about the rotation axis, and wherein the second displacement angle is defined in the second direction about the rotation axis.

18. The method of claim 16, wherein determining the load size comprises comparing a magnitude of the first displacement angle to a predetermined correlation relating displacement magnitude to load size.

19. The method of claim 16, wherein the first displacement angle is a maximum angle of displacement about the rotation axis within a predetermined time period following directing the first rotational impulse, wherein the second displacement angle is a maximum angle of displacement about the rotation axis within the predetermined time period following directing the second rotational impulse.

20. The method of claim 15, wherein the method further comprises:

flowing a volume of liquid into the tub prior to directing the first rotational impulse.

* * * * *